US005131366A

United States Patent [19]

Rawlings et al.

[11] Patent Number: 5,131,366

[45] Date of Patent: Jul. 21, 1992

[54] APPARATUS FOR POSITIONING A SENSOR

[75] Inventors: David E. Rawlings, Palatine; Mark D. Whiteside, Zion, both of Ill.

[73] Assignee: Outboard Marine Corporation, Waukegan, Ill.

[21] Appl. No.: 602,919

[22] Filed: Oct. 25, 1990

Related U.S. Application Data

[63] Continuation of Ser. No. 351,041, May 12, 1989, abandoned.

[51] Int. Cl.[5] ..... F02P 7/067

[52] U.S. Cl. ..... 123/414; 73/116; 123/149 D; 123/617

[58] Field of Search ..... 123/612, 613, 614, 615, 123/616, 617, 149 D, 146.5 A, 414, 647, 599, 149 A; 73/118.1, 116; 324/208, 202, 207.11-207.14.207.22.207.25

[56] References Cited

U.S. PATENT DOCUMENTS

| | | | |
|---|---|---|---|
| 3,508,116 | 4/1970 | Burson | 123/146.5 A |
| 3,542,007 | 11/1970 | Minks | 123/599 |
| 3,903,863 | 9/1975 | Katsumata | 123/149 D |
| 4,053,826 | 10/1977 | Wasawa et al. | 324/208 |
| 4,146,806 | 3/1979 | Katsumata | 123/149 D |
| 4,222,263 | 9/1980 | Armstrong | 73/116 |
| 4,235,101 | 11/1980 | Stadelmann | 73/116 |
| 4,373,486 | 2/1983 | Nichols et al. | 123/414 |
| 4,406,272 | 9/1983 | Kiess | 123/617 |
| 4,508,092 | 4/1985 | Kiess | 123/617 |
| 4,606,305 | 8/1986 | Campen | 123/149 D |
| 4,635,353 | 1/1987 | Tamagne | 123/617 |
| 4,653,458 | 3/1987 | Bergsten | 123/612 |
| 4,677,946 | 7/1987 | Tamagne | 123/146.5 |
| 4,850,323 | 7/1989 | Ricordi | 123/414 |
| 4,903,525 | 2/1990 | Chiba et al. | 73/116 |

*Primary Examiner*—Tony M. Argenbright
*Attorney, Agent, or Firm*—Michael, Best & Friedrich

[57] ABSTRACT

Disclosed herein is apparatus for positioning a sensor relative to a rotatable timing ring included on an internal combustion engine, which apparatus includes a sensor, a structure for adjustably positioning the sensor on the internal combustion engine and relative to the timing ring, which structure is movable relative to the sensor and to the timing ring, and additional structure for fixing the sensor in adjusted position on the internal combustion engine.

18 Claims, 3 Drawing Sheets

APPARATUS FOR POSITIONING A SENSOR

BACKGROUND OF THE INVENTION

1. Field of the Invention

The present invention relates to an apparatus for positioning a sensor in an operative location relative to a related part, and more particularly to a marine propulsion device including an internal combustion engine incorporating a crankshaft mounted timing ring, and a sensor operable to provide crankshaft angular position information to time the ignition spark of the internal combustion engine.

2. Description of the Prior Art

The prior art includes sensor devices and arrangements for positioning such sensors devices which are individually operable to time the spark sequence of an internal combustion engine. Examples of such sensor devices and positioning arrangements are shown in U.S. Pat. No. 4,406,272 to Kiess et al; U.S. Pat. No. 4,373,486 to Nicholas et al U.S. Pat. No. 4,508,092 to Kiess et al; and U.S. Pat. No. 4,635,353 and U.S. Pat. No. 4,677,946 to Tamange.

Marine propulsion devices such as stern drive units have employed an electronic ignition system including a sensor consisting of a molded electrical connector and sensing element assembly bonded to a housing and including three parallel probes. A magnet is bonded into the central probe and the outer probes act as Hall effect devices. The sensor provides crankshaft angular position information to an electronic control module that controls the spark sequence of the internal combustion engine. A crankshaft mounted timing ring, which has a plurality of vane segments and which further has common rotation with the crankshaft, activates the sensor. The sensor is mounted on the internal combustion engine such that the vane segments pass through a pair of spaces defined between the probes. The movement of the vane segments through the spaces defined by the probes has the effect of shunting the magnet flux fields generated by the probes and thereby generates a predetermined series of pulses at the electronic control module that is indicative of the firing order of the internal combustion engine.

SUMMARY OF THE INVENTION

The invention provides an apparatus for positioning a sensor relative to a rotatable timing ring included on an internal combustion engine, which apparatus includes a sensor, means for adjustably positioning the sensor on the internal combustion engine, the sensor positioning means being moveable relative to the sensor and to the timing ring, and means for fixing the sensor in an adjusted position on the internal combustion engine.

In one embodiment, the invention provides an internal combustion engine for a marine propulsion device having a flywheel housing, a crankshaft extending rotatably in the flywheel housing, a flywheel fixed on the crankshaft for common rotation with the crankshaft and positioned in the flywheel housing, a timing ring fixed on the crankshaft and having common rotation therewith, a base member moveably mounted on the flywheel housing a sensor fixed on the base member, and a means for adjustably positioning the sensor relative to the timing ring, the sensor positioning means being adapted to move to and from the timing ring.

In one embodiment the base member includes a means for fixing the sensor in an adjusted position on the flywheel housing of the internal combustion engine, the sensor fixing means including a flange fixed on the base member and having an elongated adjustment slot, and wherein the flywheel housing includes a threaded bore, and a screw threadably mates with the threaded bore and extends through the adjustment slot.

In one embodiment the base member includes a pair of bores, and the means for adjustably positioning the sensor relative to the timing ring includes a pair of shafts which are individually moveably housed in each of the bores, and wherein each of the shafts has a proximal and a distal end, and the distal ends include a longitudinally disposed slot which is adapted to receive the timing ring when the individual shafts are moved toward the timing ring.

In one embodiment the sensor positioning means includes a biasing means having an elongated main body with opposite ends, and wherein the opposite ends rest on the base and include an aperture, and wherein the individual shafts extend through each of the apertures, and wherein the proximal ends of each shaft is fixed on the opposite ends of a bar and the leaf spring acts upon the bar thereby positioning the shafts away from the timing ring.

In one embodiment, alignment of the individual shafts such that the timing ring is slideably received in the longitudinal slot formed in the distal end of each shaft thereby positions the electronic sensor in a proper operational attitude relative to the timing ring, and the base member is fixed in the adjusted position on the flywheel housing thereby securing the sensor in the proper operational attitude.

The invention also provides an internal combustion engine including a flywheel housing, a crankshaft extending rotatably in the flywheel housing, a flywheel fixed on the crankshaft, having common rotation therewith, and positioned in said flywheel housing, and a timing ring fixed on the crankshaft, positioned adjacent to the flywheel, and having common rotation with the crankshaft.

The invention also provides a marine propulsion device including an internal combustion engine having a flywheel housing, a crankshaft extending rotatably in the flywheel housing, a flywheel fixed on the crankshaft and having common rotation therewith, a timing ring fixed on the crankshaft, positioned adjacent to the flywheel, and having common rotation with the crankshaft, a base member moveably mounted on the flywheel housing, a sensor fixed on the base member and moveable relative to the timing ring, means on the base member for positioning the sensor relative to the timing ring, which sensor positioning means is moveable to and from the timing ring, and means for biasing the sensor positioning means from the timing ring.

Other features and advantages of the invention will become apparent to those skilled in the art upon reviewing the following detailed description, the drawings and the appended claims.

Figure 1:
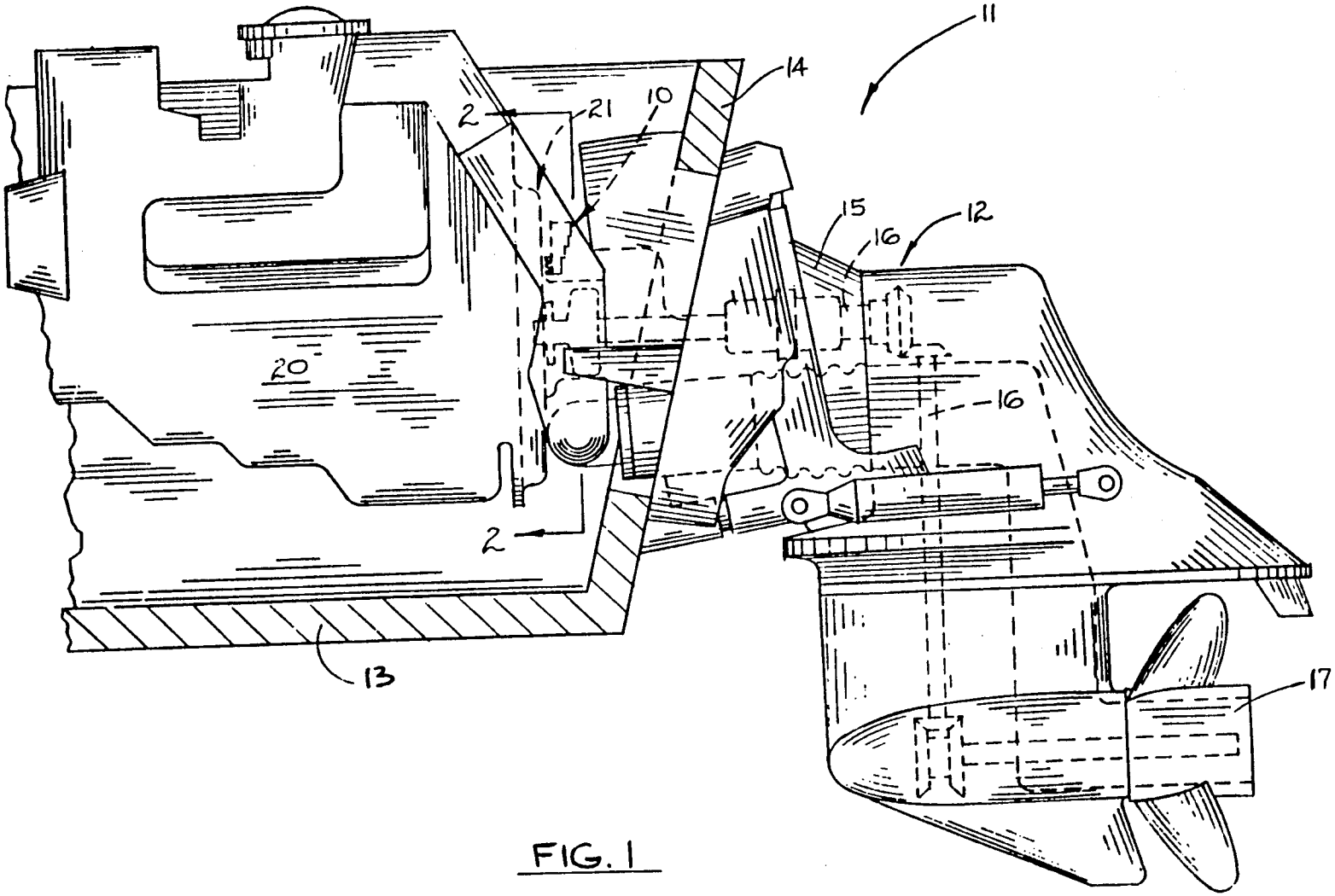
FIG. 1 is a side elevation view of the present invention shown in typical operative configuration for use with a marine propulsion device.
Figure 2:
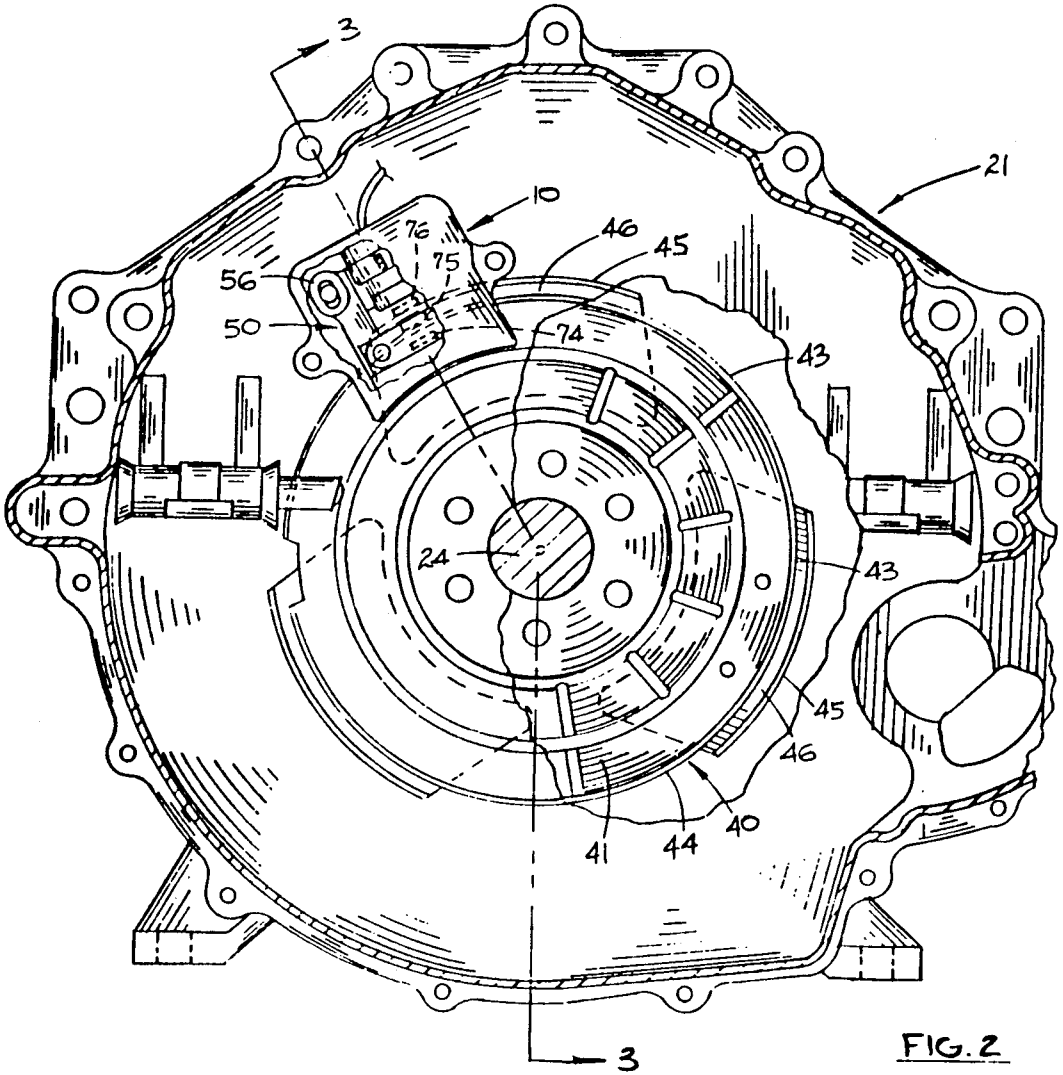
FIG. 2 is somewhat enlarged, fragmentary, transverse vertical sectional view taken generally along line 2—2 of FIG. 1 and showing the internal portion of the flywheel housing.

Before one embodiment of the invention is explained in detail, it is to be understood that the invention is not limited in its application to the details the of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

Figure 4:
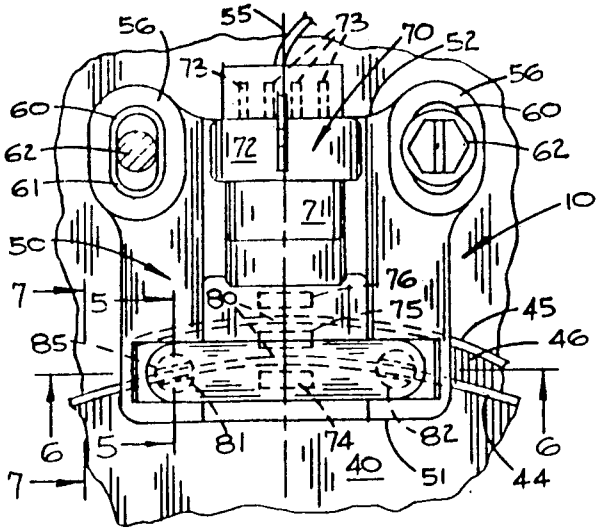
FIG. 4 is a somewhat enlarged, fragmentary, top plan view of present invention with some underlying surfaces shown in hidden lines.

Referring more particularly to the drawings, the apparatus for positioning a sensor of the present invention is generally indicated by the numeral 10 in FIG. 4. For illustrative convenience, the apparatus 10 as herein shown and described is depicted as it would be installed on, or retrofitted to, a marine propulsion device 11, which is illustrated as a stern drive unit 12 mounted on a boat 13. The boat is of common design and has a transom 14 through which a drive unit 15 extends. The drive unit 15 includes a rotatably moveable drive shaft 16 which is drivingly connected to a propeller 17. An internal combustion engine 20 is mounted in the boat and is drivingly connected to the drive unit in a fashion well understood by those skilled in the art. The internal combustion engine 20 has a flywheel housing 21 including a substantially rearwardly facing surface 22. As best illustrated by reference to FIG. 3, an opening 23 is formed in the rearwardly facing surface 22 and permits access to the inside of the flywheel housing.

A crankshaft 24 rotatably extends into the flywheel housing 21, and a flywheel 25 is fixed thereon and is adapted for common rotation therewith. The flywheel 25 has a main body 30 including a peripheral edge 31, and further has substantially forwardly and rearwardly facing surfaces 32 and 33, respectively. The main body includes a substantially centrally disposed passageway 34 through which the crankshaft passes, and a coupler assembly 35 is fixed on the flywheel 25 and has common rotation therewith. The coupler assembly is drivingly connected to the drive shaft 16 in a manner well understood in the art and therefore is not discussed in further detail herein.

A timing ring 40 has a main body 41 including a substantially centrally disposed passageway 42. The timing ring 40 is fixed on the crankshaft 24, and is disposed in a position immediately adjacent to the rearward surface 33 of the flywheel 25. This relationship is most clearly seen by reference to FIG. 3. The timing ring further has an arcuately shaped peripheral edge 43 which includes a first or inner timing vane segment 44 disposed in substantially right angular relation to the main body 41. A second or outer timing vane segment 45 is fixed on the main body 41 of the timing ring and is positioned in spaced relation to the first timing ring segment 44. A gap or space 46 is defined between the first and second timing vane segments.

Figure 3:
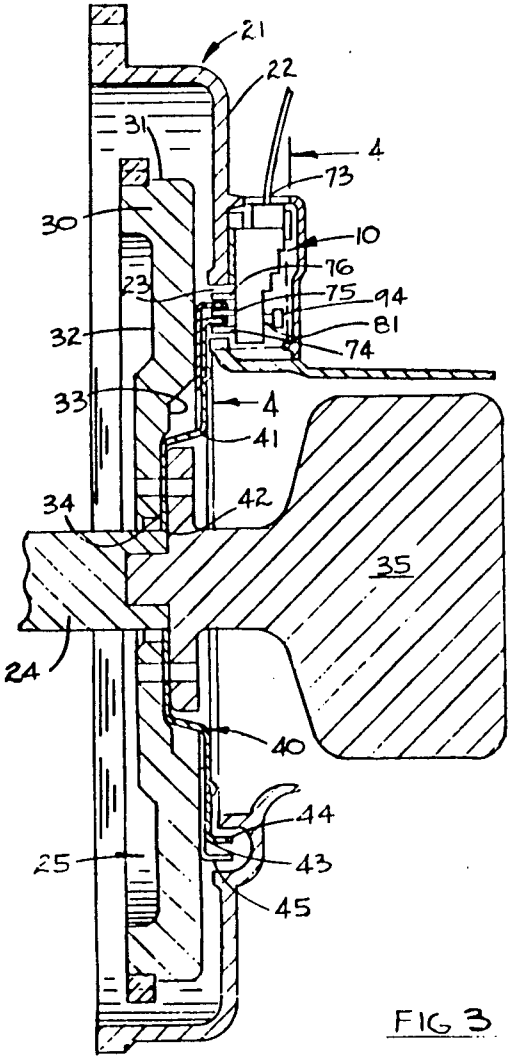
FIG. 3 is a fragmentary, somewhat enlarged, longitudinal, vertical, sectional view of the present invention taken generally along line 3—3 of FIG. 2, and showing the position of the sensor on the flywheel housing, and the vane segments of the timing ring positioned between the probes of the sensor.

As best illustrated by reference to FIGS. 3 and 4, there is also provided means for moveably mounting a sensor adapted to be adjustably fixed to the flywheel housing 21. While various arrangements can be used, in the specific construction illustrated, such means includes a base member 50 which has first and second ends 51 and 52, respectively, and top and bottom surfaces 53 and 54, respectively. The base member has a longitudinal axis which is generally indicated by the line 55 and which extends radially from the crankshaft 24. The base member 50 also has two flanges or bosses 56 which are positioned adjacent the second end, and which include respective elongated adjustment slots 60. The individual adjustment slots 60 are disposed in substantially parallel spaced relation to the longitudinal axis 55. Bushings 61 having substantially similar elongated shapes are respectively positioned in the adjustment slots, and screws 62 are respectively received in each adjustment slot. The screws 62 respectively threadably engage threaded bores (not shown) formed in the rearwardly facing surface of the flywheel housing 21. When in an untightened condition, the screws 62 permit movement of the base member 50 radially of the crankshaft, and along the longitudinal axis 55.

A pair of bores 63 and 64, respectively, are formed in the first end 51 of the base member 50 and are disposed in substantial registry with the opening 23 of the flywheel housing 21. An electronic sensor 70 is fixed on the base 50 and is moveable therewith. The sensor 70 includes a sensing element 71 and a lead frame assembly 72. A plurality of electric leads 73 are connected to the lead frame and are further connected to an electronic control module, not shown. The sensing element 71 further includes first, second and third probes 74, 75, and 76 respectively. The first and third probes carry Hall effect devices, (not shown) and the second probe carries a magnet (not shown). A gap 80 is defined between the first and second probes and a gap 80 is defined between the second and third probes. The first and second timing vane segments are respectively aligned for passage through the respective gaps 80 and in the manner as most clearly seen by reference to FIGS. 3 and 4.

Figure 5:
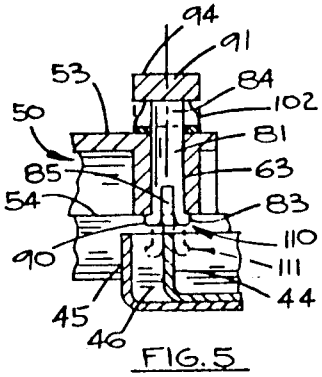
FIG. 5 is a fragmentary, longitudinal sectional view of the apparatus of the present invention taken along line 5—5 of FIG. 4, and showing the alternative positions of the individual shafts in phantom lines.

Means are provided for adjustably locating or positioning the sensor 70 relative to the timing ring 40. While various arrangements can be used, in the specific construction illustrated, such means includes first and second shafts 81 and 82, respectively, which are moveably housed in respective bores 63 and 64 in the base member 50. The shafts have proximal and distal ends 83 and 84, and are reciprocally moveable both to and from the timing ring 40 a direction perpendicular to the axis 55 and in the manner as illustrated most clearly by reference to FIG. 5. The distal end 84 of each shaft has a longitudinally disposed slot 85 positioned in substantially parallel relation with respect to a tangent to the arc which is defined by the first timing vane segment 44. This relationship is seen in FIG. 4. The distal end 84 of each shaft also has a flared portion 90 which limits the movement of the shafts away from the timing ring by engaging the bottom surface 54 of the base member 50.

Connected on the proximal ends of each shaft is a bar 91 having first and second ends 92 and 93, respectively, and top and bottom surface 94 and 95, respectively.

Figure 6:
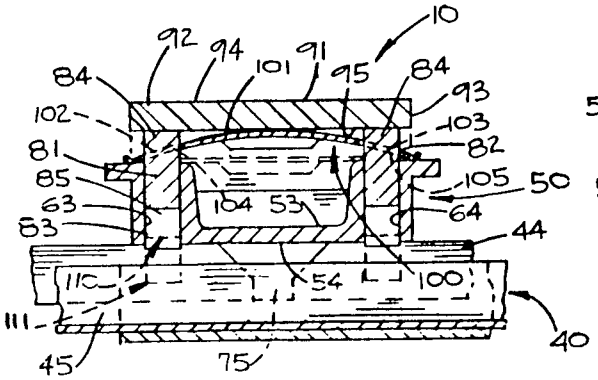
FIG. 6 is a transverse, vertical sectional view of the apparatus of the subject invention taken along line 6—6 of FIG. 4, and showing the alternative positions of the individual shafts in phantom lines.
Figure 7:
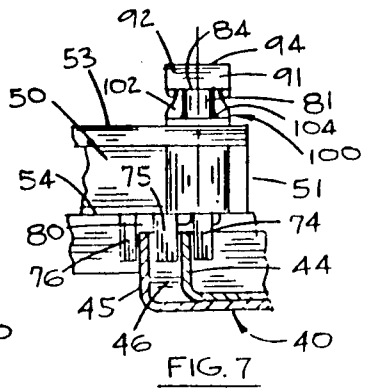
FIG. 7 is a fragmentary, side elevation of the apparatus of the subject invention taken from a position along line 7—7 of FIG. 4, and showing the relative positions of the probes with respect to the timing ring.

Means are provided for biasing the shafts 81 and 82 away from the timing ring 40. While various arrangements can be used, in the specific construction illustrated, such means includes a leaf spring 100 having an elongated substantially arcuately shaped main body 101. The leaf spring 100 also has opposite first and second ends 102 and 103, respectively. Apertures 104 and 105 are respectively provided adjacent each end. As best illustrated by reference to FIGS. 5 and 6, the leaf spring 100 is operable to act upon the bar 91, thereby positioning the shafts in a retracted position 110, shown in full lines in FIG. 5. By exerting manual force on the bar 91 the force of the biasing spring 100 can be overcome and the shafts 81 and 82 can be moved toward the timing ring 40 and into an extended position 111 shown in phantom lines in FIGS. 5 and 6.

With this arrangement, the base member 50 may be adjustably positioned relative to the flywheel housing 21 such that the probes 74, 75, and 76 are operatively positioned relative to the first and second timing vane segments 44 and 45, respectively. More specifically, when the screws 62 are loosened, movement of the base member is permitted to afford radially adjusted location of the sensor 70 in an aligned position relative to the timing ring 40. In this regard, when the sensor 70 is properly located, the bar 91 is depressable to cause movement of the shafts 81 and 82 toward the timing ring 40 and into the extended position 111. By movably adjusting the base member 50 the individual shafts can be positioned such that the first timing vane segment 44 is slideably received in each of the longitudinally disposed slots 85. When the first timing vane segment is positioned in the slots 85, the individual probes 74, 75 and 76 are operatively positioned relative to the individual timing vane segments 44 and 45. The base member 50 is then secured to the flywheel housing by tightening the screws 62. The bar is thereafter released and the shafts 81 and 82 are returned to the retracted position 110 by the action of the leaf spring 100.

Various features of the invention are set forth in the following claims:

We claim:

1. An apparatus for positioning a sensor relative to a rotatable timing ring included on an internal combustion engine, said apparatus comprising a sensor, means for adjustably positioning said sensor on said internal combustion engine and relative to said timing ring, said sensor positioning means being moveable relative to said sensor and to said timing ring, and means for fixing said sensor in an adjusted position o the internal combustion engine.

2. An apparatus in accordance with claim 1 wherein said apparatus further includes means for biasing said sensor positioning means to a location in spaced relation to said timing ring.

3. An apparatus in accordance with claim 1 wherein said sensor positioning means includes a base member having a mounting flange including an elongated adjustment slot, and wherein said sensor is fixed on said base member, and said base member is adjustably positionable on the internal combustion engine.

4. An apparatus in accordance with claim 3 wherein the internal combustion engine includes a flywheel housing, and a flywheel in said flywheel housing, and wherein said timing ring is rotatably supported in said flywheel housing and positioned adjacent to said flywheel, and wherein said base member is mounted on said flywheel housing.

5. An apparatus in accordance with claim 3 wherein said base member includes a pair of bores, and wherein said sensor positioning means includes a pair of shafts which are respectively housed in said bores, which respectively have longitudinal axes, and respectively include ends including longitudingally disposed slots which are adapted to receive said timing ring.

6. An apparatus in accordance with claim 5 wherein said sensor positioning means further includes a bar fixed on said shafts.

7. An apparatus in accordance with claim 5 wherein said biasing means includes a leaf spring having an elongated main body with opposite ends, and wherein each of said opposite ends includes an aperature, and wherein said opposite ends rest on said base member, and wherein said shafts respectively extend through said aperatures.

8. An apparatus in accordance with claim 4 wherein said flywheel housing includes a threaded bore, and wherein said sensor fixing means includes a screw threadably engaging said threaded bore, and extending through said adjustment slot.

9. An internal combustion engine comprising a flywheel housing, a crankshaft extending rotatably in said flywheel housing, a flywheel fixed on said crankshaft, having common rotation therewith, and positioned in said flywheel housing, means including a timing ring for sensing the angular position of said crankshaft, said timing ring being fixed on said crankshaft, positioned adjacent to said flywheel, having common rotation with said crankshaft, and including at least one vane segment, and a sensor movably mounted on said flywheel housing.

10. An internal combustion engine in accordance with claim 9 wherein said sensor includes a probe positioned in spaced relation relative to said vane segment, and further including a base member moveably mounted on said flywheel housing, and wherein said sensor is fixed on said base member.

11. An internal combustion engine in accordance with claim 10 and further including means fixed on said base member for positioning said sensor relative to said timing ring, said sensor positioning means being adapted to move to and from said timing ring.

12. An internal combustion engine in accordance with claim 11 wherein said base member includes a bore, and wherein said sensor positioning means includes a shaft housed in said bore and being reciprocally moveable therein, and wherein said shaft includes a slot receiving said vane segment when said shaft is moved towards said timing ring.

13. An internal combustion engine in accordance with claim 11 wherein said base member includes a means for fixing said base member in an adjusted position on said flywheel housing, and wherein said sensor positioning means includes a means for biasing said shaft away from said timing ring.

14. A marine propulsion device comprising an internal combustion engine having a flywheel housing, a crankshaft extending rotatably in said flywheel housing, a flywheel fixed on said crankshaft and having common rotation therewith, a timing ring fixed on said crankshaft, positioned adjacent to said flywheel, and having common rotation with said crankshaft, a base member moveably mounted on said flywheel housing, a sensor fixed on said base member and moveable relative to said timing ring, means on said base member for positioning said sensor relative to said timing ring, said sensor positioning means being moveable relative to said base member, and to and from said timing ring, and means for biasing said sensor positioning means from said timing ring.

15. A marine propulsion device in accordance with claim 14 wherein said base member includes a bore, and wherein said sensor positioning means includes a shaft reciprocally moveable in said bore to and from said timing ring and including an end including a slot, and wherein said timing ring is received in said slot when said shaft is moved toward said timing ring, and wherein said base member Positions said sensor in an operative position relative to said timing ring when said shaft is aligned to receive said timing ring.

16. An apparatus for positioning a sensor relative to a rotatable timing ring included on an internal combustion engine including a flywheel housing, and a flywheel in the flywheel housing, said apparatus comprising a timing ring rotatably supported in the flywheel housing and positioned adjacent to the flywheel, a sensor, means for adjustably positioning said sensor relative to said timing ring, said sensor positioning means being moveable relative to said sensor and to said timing ring and including a base member adjustably supported on said flywheel housing and including a mounting flange with an elongated adjustment slot, a pair of bores, a pair of shafts which are respectively housed in said bores, which respectively have longitudinal axes, and which respectively include ends including longitudinally disposed slots which are adapted to receive said timing ring, a bar fixed on said shafts, and means for biasing said sensor positioning means away from said timing ring and including a leaf spring having an elongated main body with opposite ends respectively including aperatures receiving said shafts and with said opposite ends resting on said base member.

17. An internal combustion engine comprising a flywheel housing, a crankshaft extending rotatably in said flywheel housing, a flywheel fixed on said crankshaft, having common rotation therewith, and positioned in said flywheel housing, a base member including a bore, and means for adjustably fixing said base member in an adjusted position on said flywheel housing, a timing ring fixed on said crankshaft and including at least one vane segment positioned adjacent to said flywheel and having common rotation with said crankshaft, a sensor fixed on said base member and including a probe positioned in spaced relation to said vane segment, means on said base member moveable to and from said timing ring for positioning said probe relative to said timing ring and including a shaft housed in said bore, reciprocally moveable therein, and including a slot receiving said vane segment incident to movement of said shaft toward said timing ring.

18. An internal combustion engine comprising a flywheel housing, a crankshaft extending rotatably in said flywheel housing, a flywheel fixed on said crankshaft, having common rotation therewith, and positioned in said flywheel housing, a timing ring fixed on said crankshaft, positioned adjacent to said flywheel, and having common rotation with said crankshaft, and a sensor moveably mounted on said flywheel housing adjacent said timing ring.

* * * * *